US006804938B2

(12) United States Patent
Levin et al.

(10) Patent No.: US 6,804,938 B2
(45) Date of Patent: Oct. 19, 2004

(54) PACKAGING DEVICE AND METHOD FOR SHIPPING FURNITURE

(75) Inventors: Marc A. Levin, Vernon Hills, IL (US); Barry L. Donahue, Glenview, IL (US)

(73) Assignee: The Ultimate Back Store, Inc., Glenview, IL (US)

( * ) Notice: Subject to any disclaimer, the term of this patent is extended or adjusted under 35 U.S.C. 154(b) by 0 days.

(21) Appl. No.: 10/004,383

(22) Filed: Oct. 31, 2001

(65) Prior Publication Data

US 2003/0079441 A1 May 1, 2003

Related U.S. Application Data

(63) Continuation-in-part of application No. 09/841,337, filed on Apr. 24, 2001, now abandoned.

(51) Int. Cl.[7] ..... B65B 11/58; B65B 23/00

(52) U.S. Cl. ..... 53/449; 53/397; 53/467; 53/472; 53/474

(58) Field of Search ..... 53/397, 399, 449, 53/467, 472, 474, 139.5, 139.7; 206/326, 320; 297/440.1, 440.13, 440.14, 440.15, 440.22, 440.23, 440.24

(56) References Cited

U.S. PATENT DOCUMENTS

| | | | | | |
|---|---|---|---|---|---|
| 1,131,948 | A | | 3/1915 | Osborn | |
| 1,188,825 | A | | 6/1916 | Potter | |
| 1,686,834 | A | | 10/1928 | Nickerson | |
| 2,068,095 | A | | 1/1937 | Weltzien | |
| 2,331,753 | A | | 10/1943 | Wohlers | |
| 2,479,453 | A | * | 8/1949 | Amatel | 53/472 |
| 2,832,525 | A | | 4/1958 | Cavin | |
| 2,994,425 | A | * | 8/1961 | Honeycutt | 53/472 |
| 3,033,358 | A | | 5/1962 | Mantell et al. | |
| 3,192,680 | A | | 7/1965 | Mantell et al. | |
| 3,557,518 | A | | 1/1971 | Purkey | |
| 3,675,765 | A | * | 7/1972 | Melsek | 206/320 |
| 3,727,981 | A | | 4/1973 | Ostroff et al. | |
| 3,729,893 | A | * | 5/1973 | Bobb | 53/449 |
| 3,934,720 | A | | 1/1976 | Kratochvil, Jr. | |
| 3,978,982 | A | | 9/1976 | Duncan | |
| 3,992,849 | A | | 11/1976 | Lett, III | |
| 4,098,401 | A | | 7/1978 | Brown et al. | |
| 4,111,301 | A | | 9/1978 | English | |
| 4,185,741 | A | * | 1/1980 | Schiff et al. | 206/326 |
| 4,299,423 | A | * | 11/1981 | Saiger | 297/440.24 |
| 4,324,433 | A | * | 4/1982 | Saiger | 297/440.13 |
| 4,584,822 | A | * | 4/1986 | Fielding et al. | 53/472 |
| 4,619,362 | A | | 10/1986 | Crowe et al. | |
| 4,620,396 | A | | 11/1986 | Bjorntwedt | |
| 4,627,223 | A | * | 12/1986 | Janhonen | 53/449 |
| 4,759,446 | A | | 7/1988 | Dobashi et al. | |
| 4,871,061 | A | | 10/1989 | Schneider et al. | |
| 4,974,906 | A | * | 12/1990 | Hines | 297/440.13 |
| 5,074,621 | A | | 12/1991 | McDonald | |
| 5,184,871 | A | | 2/1993 | LaPointe et al. | |
| 5,263,582 | A | | 11/1993 | Schaaf | |
| 5,301,491 | A | | 4/1994 | Boardman, Jr. et al. | |
| 5,407,250 | A | | 4/1995 | Prince et al. | |
| 5,469,692 | A | | 11/1995 | Xanthopoulos | |
| 5,683,142 | A | | 11/1997 | Gunderson et al. | |
| 5,849,394 | A | | 12/1998 | Bussey, III et al. | |
| 6,056,121 | A | | 5/2000 | Olson | |
| 6,067,777 | A | | 5/2000 | Stoll | |
| 6,109,695 | A | * | 8/2000 | Kahwaji | 297/440.13 |
| 6,418,700 | B1 | * | 7/2002 | Parcels | 53/472 |

* cited by examiner

*Primary Examiner*—Stephen F. Gerrity
*Assistant Examiner*—Louis Huynh
(74) *Attorney, Agent, or Firm*—Wildman, Harrold, Allen & Dixon LLP

(57) ABSTRACT

A method for shipping a piece of furniture having a base section removably secured to a seat section that involves removing the seat section from the base section and inserting the seat section and the base section into a shipping container. A packaging apparatus suitable for overnight delivery which includes a shipping container and at least one shipping sleeve capable of receiving an edge portion of the seat section of the furniture with the at least one shipping sleeve positionable within the shipping container to abut a side wall of the shipping container is also disclosed.

91 Claims, 2 Drawing Sheets

PACKAGING DEVICE AND METHOD FOR SHIPPING FURNITURE

CROSS REFERENCE TO RELATED APPLICATION

This application is a continuation-in-part of U.S. patent application Ser. No. 09/841,337 entitled "Packaging Device and Method of Shipping" by Marc A. Levin and Barry L. Donahue, filed Apr. 24, 2001, now abandoned.

FIELD OF THE INVENTION

The invention relates generally to the shipment of goods and, more particularly, to a method and apparatus for packaging furniture for overnight delivery.

BACKGROUND OF THE INVENTION

In any retail business one of the factors that effects the purchase price charged to the consumer is the shipping or distribution cost. This cost which varies depending upon, among other things, the method of transportation used and the speed of delivery can have an impact not only on the purchase price but also on the ability to make the sale and the degree of customer satisfaction.

In the era of "just-in-time" inventory and delivery, it has become imperative that goods be shipped as quickly and economically as possible. This has resulted in a highly competitive overnight delivery industry that allows retailers to deliver goods to the consumer in one or two days.

A limitation imposed by overnight delivery companies, however, involves the size of the containers in which goods can be shipped overnight. This size constraint, although necessary to allow container handling by one person, creates a problem for sellers of goods such as furniture that do not fit in a container that satisfies the requirements for overnight delivery. Given the container size limitation imposed by overnight deliver companies, a packaging method and apparatus that would allow shippers of goods such as furniture to take advantage of the cost savings and customer satisfaction generated by being able to ship overnight would be an important improvement in the art.

SUMMARY OF THE INVENTION

The invention involves a method for shipping a piece of furniture having a seat section removably secured to a base section. The method is comprised of the steps of removing the seat section from the base section and inserting the seat section and the base section into a shipping container.

The invention also involves a packaging apparatus for packing a piece of furniture having a base section removable from a seat section. This packaging apparatus is comprised of a shipping container and at least one shipping sleeve capable of receiving an edge of the seat section where the shipping sleeve is capable of being positioned within the shipping container so as to abut and support at least one side wall of the shipping container.

The purpose of the invention is to provide a new method and apparatus for packaging and shipping furniture that overcomes some of the problems and shortcomings of the prior art. This is accomplished by providing a new method and apparatus for packaging and shipping furniture that allows the furniture to be shipped via an overnight delivery service.

DETAILED DESCRIPTION OF THE INVENTION

As shown in FIGS. 1–7, the invention involves a method and an apparatus for shipping a piece of furniture 10 having a seat section 12 removably secured to a base section 14. The method is comprised of the steps of removing the seat section 12 from the base section 14 and inserting the seat section 12 and the base section 14 into a shipping container 20.

In one embodiment of the invention, the furniture 10 is a chair, however, any suitable piece of furniture utilizing a base section could be used without departing from the spirit of the invention.

In another embodiment of the invention, the furniture 10 is shipped via an overnight delivery service. In such embodiment, the shipping container 20 may have outside dimensions of 26 inches in width, 26 inches in depth, and 25 inches in height, however, other dimensions suitable for overnight delivery may also be used without departing from the spirit of the invention.

For purposes of this invention, an overnight delivery container 20 is defined as a container having a DIM measurement of 130 inches or less. The use, however, of containers suitable for overnight delivery having DIM measurements no greater than 150 inches is also contemplated as being within the scope of the invention. The DIM measurement is calculated by adding the length of the four sides of a container 20 to its height. In the above example, the DIM would be 129 inches (i.e., 26+26+26+26+25). The container 20 is constructed of any suitable material, including a regular slotted, 500 lb double wall corrugated container.

Figure 3:
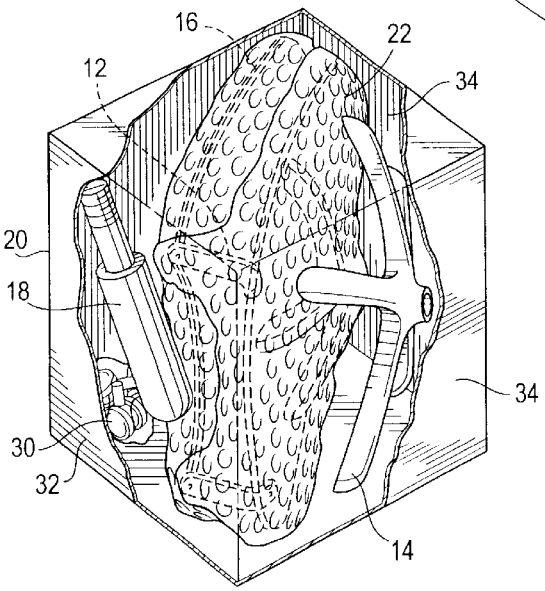
FIG. 3 is a partial cut-away perspective view of a shipping container showing the seat and back sections wrapped in a protective wrap and packaged diagonally within the container as well as the center post and base section positioned inside of the container.
Figure 4:
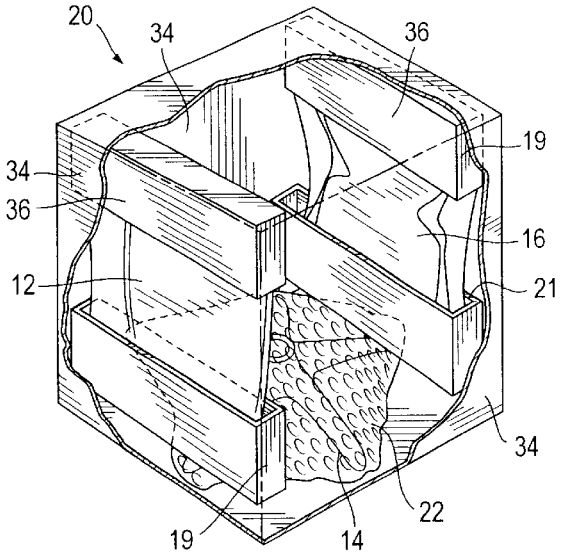
FIG. 4 is a partial cut-away perspective view of a shipping container showing the edges of the seat and back sections contained in shipping sleeves and the seat and back sections packaged against opposing side walls of the container.
Figure 7:
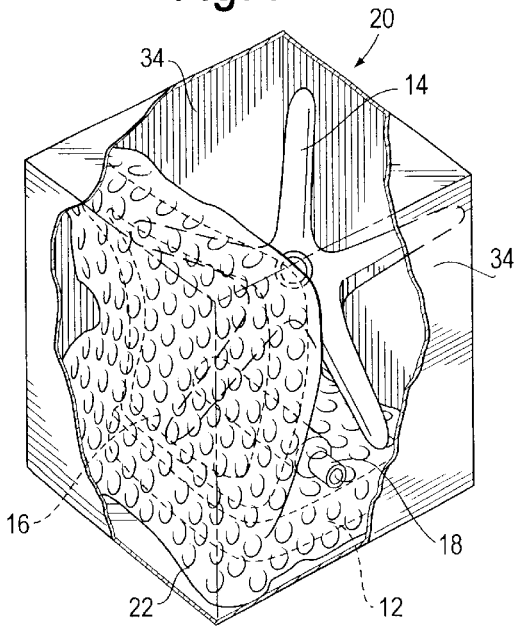
FIG. 7 is a partial cut-away perspective view of a shipping container showing the back section secured to the seat section wrapped in a packaging material and placed in a shipping container with the base and center post packaged on top of the seat section.

As shown in FIGS. 3, 4 and 7, any or all portions of the furniture 10 may be wrapped in protective material 22 prior to being inserted into the shipping carton 20. This material may, for example, be placed around all the base section 14 to prevent it from scraping against the seat section 12 when it is positioned in the container 20 along with the base 14, as shown in FIG. 4. The seat section 12 may also be covered, however, such covering is not a requirement of the invention. The protective covering 22 may be constructed of bubble wrap, fiber-filled wrap, an air-filled wrap or other suitable material.

Figure 1:
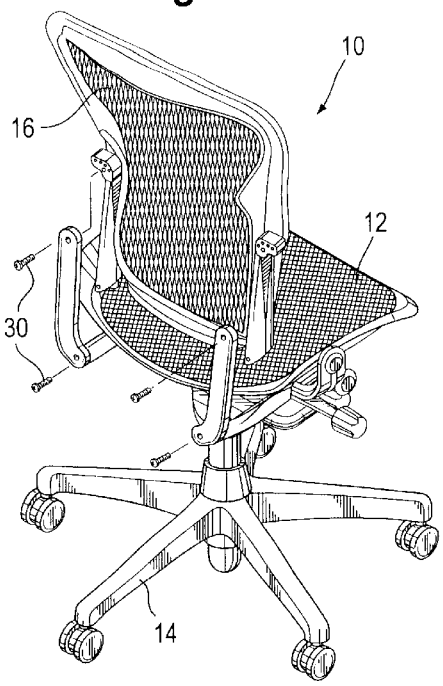
FIG. 1 is a perspective view of a piece of furniture used in one embodiment of the invention.

Furniture 10 may also include accessory parts 30, as seen in FIGS. 1 and 3, which are necessary for reassembly. These parts, which may include attachment screws for a seat and back sections 12 and 16 as well as assembly tools, are attached to the furniture 10. In a specific version of such embodiment the accessory parts 30 are secured in an accessory bag 32 which is attached to the furniture 10 in any suitable manner including, for example, by securing the accessory bag 32 to the furniture 10. Such accessory parts 30 may be attached to any of the packaging material, including shipping sleeves 36 without departing from the spirit of the invention.

In practicing the invention, the seat section 12 of the furniture 10 is removed from the base 14 using appropriate tools such as an Allen wrench or the like. In one embodiment of the invention, a center post 18 is used to connect the seat section 12 to the base section 14. This center post 18 which may be an elevation piston is also removed from both the seat section 12 and the base section 14 prior to those parts being placed in a shipping container 20.

Figure 5:
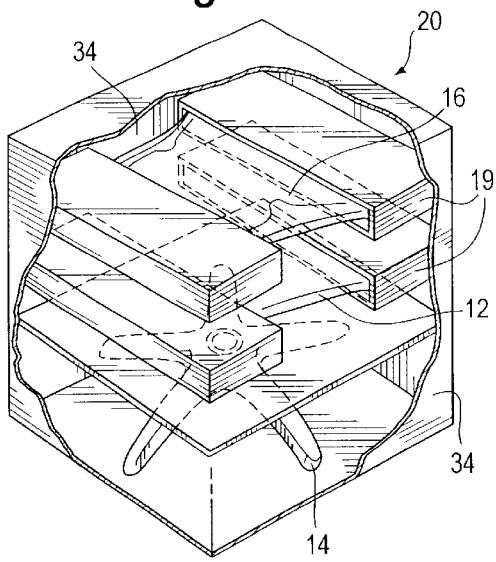
FIG. 5 is a partial cut-away perspective view of a shipping container showing the edges of the seat and back sections contained in shipping sleeves and the seat and back sections stacked vertically on top of the base.
Figure 6:
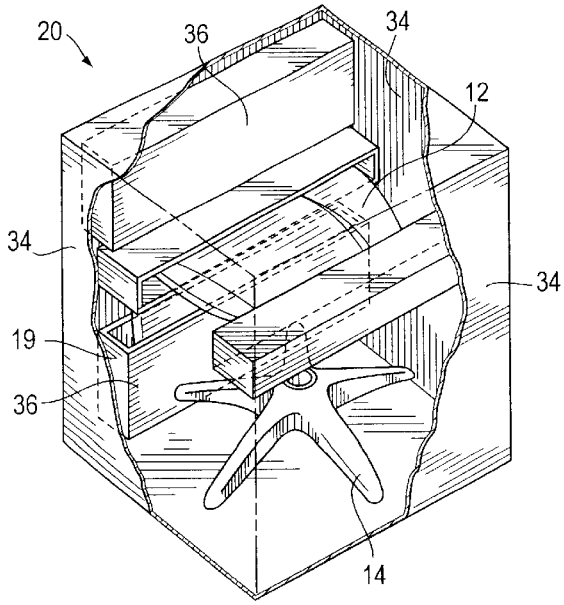
FIG. 6 is a partial cut-away perspective view of a shipping container showing the edges of the seat and back sections contained in shipping sleeves and the seat section packaged on top of the base with the back section packaged between the seat section and one of the side walls.

In yet another embodiment of the invention, as shown in FIG. 1, the furniture 10 includes a back section 16 secured to the seat section 12. In a specific version of such embodiment, the back section 16 is removably secured to the seat section 12, however, the furniture 10 may be packaged in a shipping container 20 with the back section 16 attached to the seat section 12 as shown in FIG. 7. When the back section 16 is removed from the seat section 12, the inventive method for shipping the furniture 10 is further comprised of the steps of removing the back section 16 from the seat section 12 and inserting both the back section 16 and the seat section 12 into the shipping container 20. The back section 16 may be positioned: (1) generally parallel to the seat section 12 generally along the diagonal of the container 20, as shown in FIG. 3; (2) between the seat section 12 and a side wall 34 of the shipping container 20 and generally transverse to the seat section 12 which is vertically stacked on the base 14, as shown in FIG. 6; (3) along a side wall 34 opposite of the seat section 12 as shown in FIG. 4; (4) to overlie the seat section 12 in a vertical stack, as shown in FIG. 5; or (5) so as to be nested between arms (not shown) that may be connected to the seat section 12.

In practicing this specific version of the invention, the seat section 12 of the furniture 10 is removed from the base 14 using appropriate tools such as an Allen wrench or the like. In the same manner, the back section 16 is removed from the seat section 12. Once removed, a protective wrapping 22 is placed around the seat and back sections 12 and 16 and such sections are placed generally parallel with one another and generally along a diagonal of the container 20 as shown in FIG. 3. Any remaining furniture parts including, for example, the center piston 18 are placed in container 20 on either side of the seat and back section 12, 16.

Figure 2:
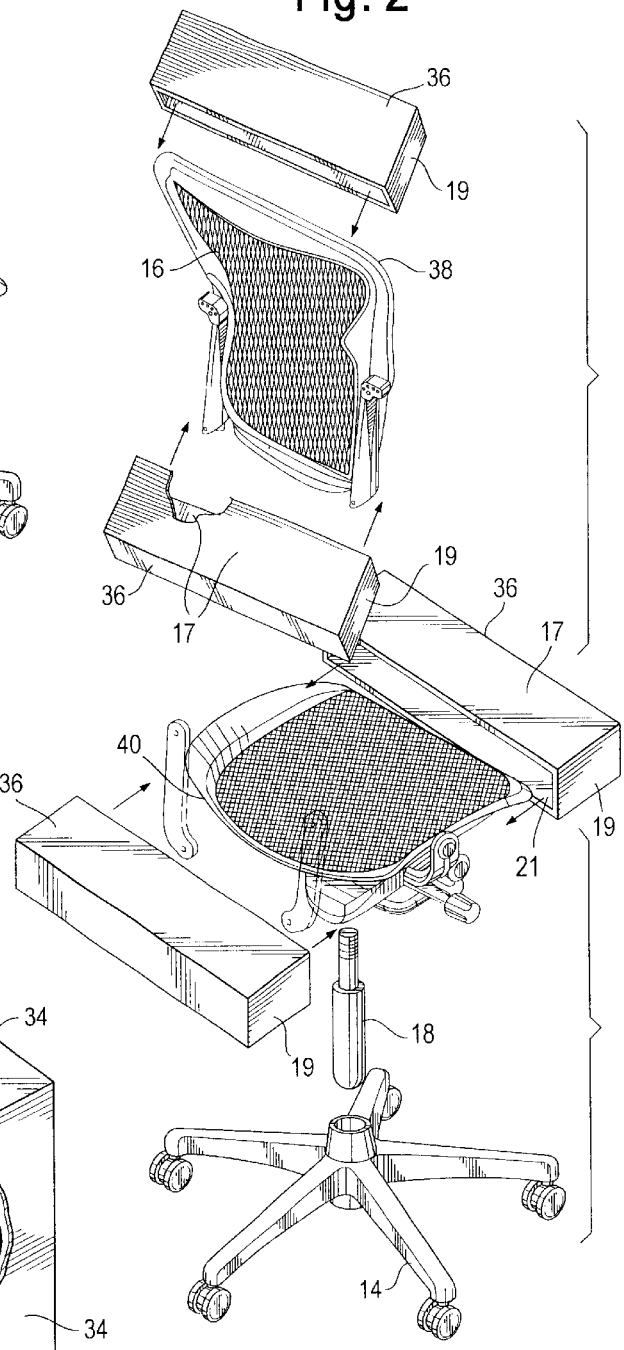
FIG. 2 is a perspective exploded view of the furniture shown in FIG. 1 with the back section removed from the seat section and shipping sleeves aligned for positioning over opposing edge portions of the back and seat sections in which one shipping sleeve is partially cut-away.

In another embodiment of the invention, at least one protective shipping sleeve 36 is placed over or in contact with the edge 38 of the back section 16. The shipping sleeve 36 may measures 25.5 inches wide by 7 inches deep by 2 inches high, however, the invention does not preclude the use of sleeves 36 of other dimensions. Shipping sleeves 36 are preferably made out of perforated single wall 275 psi corrugated cardboard, however, other suitable materials such as Styrofoam® may also be used. Additionally, other types of packaging material such as pillows filled with air or fiber may also be used as shipping sleeves 36 when such materials are placed in contact with the edge 38 of the back section 16. If necessary for shipment, a shipping sleeve 36 may also be placed in contact with or over an edge portion 40 of the seat section 12, as shown in FIG. 2.

In one version of the embodiment, at least one of the shipping sleeves 36 supports at least one side wall 34 of the shipping container 20. In a more specific version of this embodiment, as shown in FIGS. 4–6, more than one shipping sleeve 36 is used, and each shipping sleeve 36 supports at least one side wall 34 of the shipping container 20. As stated above, such shipping sleeve 36 can be made of any suitable packaging material including, for example, corrugated cardboard or Styrofoam®.

Shipping sleeve 36 is a structure which encases or contacts at least a portion of the edge 38, 40 of the back section 16 or the seat section 12. The sleeve 36, as seen in more detail in FIG. 2, may be constructed to take on a generally rectangular shape having top and bottom wall members 17, side wall members 19, and at least one opening 21 for receiving an edge portion 38, 40 of back section 16 or seat section 12. The sleeve 36 is positionable between a side wall 34 of the container 20 and the edge 38 and provides a surface for abutting the side wall 34 of the container 20. It should be well understood that sleeve 36 can take on many shapes that will satisfy the requirements of the present invention including a U-shaped construction having multiple side openings or a pillow abutting an edge portion 38,40 of the back or seat section 16, 12. A U-shaped sleeve 16 would be wrapped around such edge portion 38, 40.

In another version of the embodiment, arms (not shown) are connected to the seat section 12, and the back section 16 when removed may be positioned to overlie the arms when the base 14, seat 12 and back section 16 are packaged in a vertical stack. In such an embodiment, a piece of cardboard or the like may be placed between the base 14 and the seat section 12. Moreover, the back section 16, when removed from the seat section 12, may be nested between the arms and overlie seat section 12.

The insertion of the furniture 10 into the shipping container 20 includes positioning at least one shipping sleeve 36 to abut opposing side walls 34 of the container 20. As shown in FIGS. 4–6, shipping sleeve 36, when positioned within the shipping container 20, has side wall members 19 positioned to abut at least one side wall 34 of container 20 so as to support the side walls 34.

The insertion of the furniture 10 into the shipping container 20 may, as shown in FIGS. 4–6 also involve positioning two shipping sleeves 36 such that a first sleeve 36 is placed over the edge portion 38, 40 of the back or seat section 16, 12 and a second sleeve 36 is placed over an opposing edge portion 38, 40 of the back or seat section 16, 12. Insertion of the furniture 10 into the container 20 may, as shown in FIGS. 5 and 6, also include abutting the first shipping sleeve 36 against a first side wall 34 of the container 20 adjacent an edge 40, 38 of the seat 12 or back section 16, and abutting the second shipping sleeve 36 against an opposing second side wall 34 of the container 20, where the second side wall 34 of the container 20 is adjacent an opposing edge 40, 38 of the seat 12 or back section 16 thereby providing support to side walls 34.

FIG. 2 shows the inventive method in which a first protective shipping sleeve 36 and a second protective shipping sleeve 36 are placed on a first and second edge portion 40, 38 of the seat 12 or back section 16, respectively and the back section 16 is positioned so as to overlie seat section 12, as seen in FIG. 5. Once this is accomplished and prior to insertion into the container 20, all of the furniture 10 is enclosed in protective bag (not shown), and the protective bag is placed in a shipping container 20, in such a manner that each of the protective shipping sleeves 36 abut at least one side wall 34 of the shipping container 20.

In still another embodiment of the invention, the back section 16 of the furniture 10 is positioned between the seat section 12 and a side wall 34 of the packaging container 20, as shown in FIG. 6. In this embodiment, side wall members 19 of shipping sleeves 36 abut opposing side walls 34 of container 20 thereby providing additional support to container 20.

The invention also involves a packaging apparatus for packing a piece of furniture 10 having a base section 14 removable from a seat section 12. The above description of the packaging used with the inventive method is herein incorporated in the description of the packaging apparatus. The packaging apparatus is comprised of shipping container 20 and at least one shipping sleeve 36 capable of receiving an edge portion 40 of the seat section 12 of the furniture 10, whereby the shipping sleeve 36 abuts a side wall 34 of the shipping container 20.

At least two shipping sleeves 36 may be placed on the edge portion 40 of the seat section 12 and each of these shipping sleeves 36 abuts at least one side wall 34 of the shipping container 20. Such shipping sleeves 36 may be made of any suitable packaging material including, for example, corrugated cardboard or Styrofoam®.

Furthermore, at least a portion of one shipping sleeve 36 abuts at least one side wall 34 of the shipping container 20 when the sleeve 36 is positioned within the shipping container 20. Additionally, the shipping sleeve 36 may abut opposing side walls 34 of the shipping container 20.

As shown in FIGS. 2, and 4–6, the packaging apparatus may also have a first and second shipping sleeve 36 in which the first shipping sleeve 36 is positionable over the edge portion 38 of the back section 16 and the second shipping sleeve 36 is positionable over an opposing edge 38 of the back section 16. In the configuration shown in FIG. 5, the first sleeve 36 abuts a side wall 34 of the container 20 adjacent an edge 38 of the back section 16 and the second sleeve 36 abuts a second side wall 34 of the container 20 where the second side wall 34 is adjacent the opposing edge 38 of the back section 16, thereby supporting side walls of container 20.

The shipping container 20 which is part of the packaging apparatus, is suitable for use by an overnight delivery service. The discussions with regard to the dimensions and dimension restrictions associated with container 20 have been set forth above.

While a detailed description of various embodiments of the invention have been given, it should be appreciated that many variations can be made thereto without departing from the scope of the invention as set forth in the appended claims.

What is claimed:

1. A method comprising the steps of:

providing an office chair including a seat section, a back section, and a base section, the base section including a central axis, and a plurality of leg members extending in a radial direction relative to the central axis and wherein each of the plurality of leg members is adapted to accept wheels;

providing a single shipping container including a DIM of no greater than 150 inches;

arranging the base section, the seat section and the back section inside the single shipping container so that the single shipping container is capable of closing;

closing the single shipping container; and sending the single shipping container via an overnight delivery service.

2. The method of claim 1 further providing the shipping container including outside dimensions of approximately 26 inches in width, 26 inches in depth, and 25 inches in height.

3. The method of claim 1 wherein the shipping container has a DIM of no greater than 130 inches.

4. The method of claim 1 wherein the shipping container is suitable for use by an overnight delivery service.

5. The method of claim 1 wherein the shipping container has a DIM no greater than 135 inches.

6. The method of claim 1 wherein the shipping container has a DIM no greater than 140 inches.

7. The method of claim 1 wherein the seat section and the base section are in a separated condition.

8. The method of claim 1 further comprising the step of covering at least a portion of the office chair with a protective material.

9. The method of claim 8 wherein the protective material is constructed of a bubble wrap.

10. The method of claim 8 wherein the protective material is constructed of a fiber-filled wrap.

11. The method of claim 8 wherein the protective material is constructed of an air-filled wrap.

12. The method of claim 8 wherein the step of covering includes placing protective material around the seat section.

13. The method of claim 1 further comprising the step of enclosing the seat section or the base section in a bag.

14. The method of claim 1 further comprising the steps of providing accessory parts and securing the accessory parts to the office chair before the closing step.

15. The method of claim 14 further comprising placing the accessory parts in to an accessory bag.

16. The method of claim 15 further comprising the step of taping the accessory bag to the office chair.

17. The method of claim 1 wherein the back section is removably secured to the seat section and the method further comprises the steps of:

removing the back section from the seat section; and inserting the back section into the shipping container.

18. The method of claim 17 further comprising the step of placing at least one protective shipping sleeve in contact with an edge portion of the back section prior to inserting the back section into the shipping container.

19. The method of claim 18 wherein the step of inserting further includes the step of positioning a portion of the at least one sleeve to abut at least one side wall of the shipping container.

20. The method of claim 18 wherein the step of inserting includes positioning the at least one shipping sleeve to abut opposing side walls of the shipping container.

21. The method of claim 18 comprising the further step of providing the at least one shipping sleeve constructed of corrugated cardboard.

22. The method of claim 18 wherein the step of placing includes positioning two shipping sleeves such that a first sleeve is placed in contact with the edge portion of the back section and a second sleeve is placed in contact with an opposing edge portion of the back section.

23. The method of claim 22 wherein the step of arranging further comprises:

abutting the first shipping sleeve against a first side wall of the container adjacent an edge of the back section; and abutting the second shipping sleeve against an opposing second side wall of the container, where the second side wall of the container is adjacent an opposing edge of the back section.

24. The method of claim 22 further comprising the steps of:

placing a first protective shipping sleeve and a second protective shipping sleeve in contact with the edge portion of the back section and an opposing edge portion of the back section, respectively;

wrapping the seat section in a protective material;

positioning the back section to overlie the seat section;

placing the back and seat section within a protective bag; and positioning the protective bag into a shipping container with the first and second protective shipping sleeves each abutting at least one side wall of the shipping container.

25. The method of claim 1 in which the step of inserting includes positioning the back section and the seat section in the container generally aligned in a direction of two opposing corners of the shipping container.

26. The method of claim 1 wherein the back section and the seat section are individually wrapped in a protective cover.

27. The method of claim 1 in which the step of inserting includes positioning the back section between the base section and a side wall of the shipping container in a non-parallel relationship to the base section.

28. The method of claim 1 further comprising the step of positioning the back section to overlie the seat section.

29. The method of claim 1 wherein a pair of arms are connected to the seat section and the method further comprises the step of positioning the back section to overlie the arms.

30. The method of claim 1 wherein a pair of arms are connected to the seat section and the method further comprises the step of nesting the back section between the arms.

31. The method of claim 1 further comprising the step of placing at least one protective shipping sleeve over an edge portion of the back section prior to arranging the back section in the shipping container.

32. The method of claim 31 wherein the step of arranging further includes the step of positioning a portion of the at least one sleeve to contact at least one side wall of the shipping container.

33. The method of claim 31 wherein the step of arranging includes positioning the at least one shipping sleeve to abut opposing side walls of the shipping container.

34. The method of claim 31 comprising the further the step of providing the at least one shipping sleeve constructed of corrugated cardboard.

35. The method of claim 31 wherein the step of placing includes positioning two shipping sleeves such that a first sleeve is placed over the edge portion of the back section and a second sleeve is placed over an opposing edge portion of the back section.

36. The method of claim 35 wherein the step of arranging further comprises:

abutting the first shipping sleeve against a first side wall of the container adjacent an edge of the back section; and abutting the second shipping sleeve against an opposing second side wall of the container, where the second side wall of the container is adjacent an opposing edge of the back section.

37. The method of claim 36 further comprising the steps of:

wrapping the seat section in a protective material;

positioning the back section to overlie the seat section;

placing the back and seat section within a protective bag; and positioning the protective bag into a shipping container with the first and second protective shipping sleeves each abutting at least one side wall of the shipping container.

38. A method comprising the steps of:

providing an office chair including a seat section, a back section, and a base section including a central axis, wherein the base section comprises a plurality of leg members extending in a radial direction relative to the central axis;

providing a single shipping container including a DIM of no greater than 130 inches;

arranging the seat section, the back section and the base section inside the single shipping container so that the single shipping container is capable of closing;

closing the single shipping container; and sending the single shipping container via overnight delivery.

39. The method of claim 38 further comprising providing the shipping container including outside dimensions of approximately 26 inches in width, 26 inches in depth, and 25 inches in height.

40. The method of claim 38 wherein the shipping container is suitable for use by an overnight delivery service.

41. The method of claim 38 wherein the seat section and the back section are in a separated condition.

42. The method of claim 38 further comprising the step of covering at least a portion of the office chair with a protective material.

43. The method of claim 42 wherein the protective material is constructed of a bubble wrap.

44. The method of claim 43 further providing the shipping container including outside dimensions of approximately 26 inches in width, 26 inches in depth, and 25 inches in height.

45. The method of claim 42 wherein the protective material is constructed of a fiber-filled wrap.

46. The method of claim 42 wherein the protective material is constructed of an air-filled wrap.

47. The method of claim 42 wherein the step of covering includes placing protective material around the seat section.

48. The method of claim 42 further comprising the step of enclosing the covered office chair in a bag.

49. The method of claim 38 further comprising providing accessory parts and securing the accessory parts to the office chair before the closing step

50. The method of claim 49 further comprising placing the accessory parts in an accessory bag.

51. The method of claim 49 further comprising the step of taping the accessory bag to the office chair.

52. The method of claim 38 wherein the base section is individually wrapped in a protective cover.

53. The method of claim 38 further comprising the step of positioning the base section under the seat section.

54. The method of claim 38 wherein arms are connected to the seat section and the method further comprises the step of positioning the back section to overlie the arms.

55. The method of claim 54 wherein arms are connected to the seat section and the method further comprises the step of nesting the back section between the arms.

56. The method of claim 38 further comprising the step of placing at least one protective shipping sleeve over an edge portion of the back section prior to the arranging step.

57. The method of claim 56 wherein the step of arranging further includes the step of positioning a portion of the at least one sleeve to abut at least one side wall of the shipping container.

58. The method of claim 56 wherein the step of arranging includes positioning the at least one shipping sleeve to contact opposing side walls of the shipping container.

59. The method of claim 56 further comprising the step of providing the at least one shipping sleeve constructed of corrugated cardboard.

60. The method of claim 56 wherein the step of placing includes positioning two shipping sleeves such that a first sleeve is placed over the edge portion of the back section and a second sleeve is placed over an opposing edge portion of the back section.

61. The method of claim 56 wherein the step of inserting further comprises:

abutting the first shipping sleeve against a first side wall of the container;

abutting the second shipping sleeve against an opposing second side wall of the container.

62. A method comprising the steps of:

providing an office chair including a seat section, a back section, and a base section including a central axis, wherein the base section comprises a plurality of leg members extending in a radial direction relative to the central axis and wherein each of the plurality of leg members is adapted to accept wheels;

providing a single shipping container including a DIM of no greater than 130 inches;

positioning the back section between the base section and a sidewall of the shipping container in a non-parallel relationship to the base section;

arranging the seat section inside the single shipping container relative to the back section and the base section so that the single shipping container is capable of closing;

closing the single shipping container; and sending the single shipping container via overnight delivery.

63. The method of claim 62 further comprising the step of covering at least a portion of the office chair with a protective material.

64. The method of claim 63 wherein the step of covering includes providing the protective material constructed of a bubble wrap.

65. The method of claim 63 wherein the step of covering includes placing protective material around the seat section.

66. The method of claim 63 further comprising the step of enclosing the covered office chair in a bag prior to the step of inserting.

67. The method of claim 62 further comprising the steps of providing accessory parts and securing accessory parts to the office chair prior to the closing step.

68. The method of claim 67 further comprising placing the accessory parts in to a bag.

69. The method of claim 68 further comprising the step of taping the bag to the office chair.

70. The method of claim 68 further comprising the step of providing a shipping sleeve and securing accessory parts to the shipping sleeve.

71. The method of claim 62 further comprising the step of positioning the back section to overlie the seat section.

72. The method of claim 62 further comprising the step of placing the back section to overlie arms which are connected to the seat section.

73. The method of claim 72 further comprising the step of nesting the back section between the arms.

74. A method comprising the steps of:

providing an office chair including a seat section, a back section, and a base section including a central axis, wherein the base section comprises a plurality of leg members extending in a radial direction relative to the central axis and wherein each of the plurality of leg members is adapted to accept wheels;

providing a single shipping container including a DIM of no greater than 150 inches;

positioning the back section and the seat section in the single shipping container in such a manner so as to position the back section between the seat section and a portion of the shipping container;

arranging the base section inside the single shipping container relative to the back section and the seat section so that the single shipping container is capable of closing;

closing the single shipping container; and sending the single shipping container via overnight delivery.

75. The method of claim 74 further comprising the step of covering at least a portion of the office chair with a protective material.

76. The method of claim 75 wherein the step of covering includes providing the protective material constructed of a bubble wrap.

77. The method of claim 75 wherein the step of covering includes placing protective material around the seat section.

78. The method of claim 75 further comprising the step of enclosing the covered office chair in a bag prior to the step of inserting.

79. The method of claim 74 further comprising the step of providing accessory parts and securing the accessory parts to the office chair before the closing step.

80. The method of claim 79 further comprising placing the accessory parts in to a bag before the step of securing the accessory parts to the office chair.

81. The method of claim 79 further comprising the step of providing a shipping sleeve and securing accessory parts to the shipping sleeve.

82. The method of claim 74 further comprising the step of taping a bag to the office chair.

83. The method of claim 74 further comprising the step of positioning the back section to overlie the seat section.

84. The method of claim 74 further comprising the step of nesting the back section between the arms.

85. The method of claim 74 further providing the shipping container including outside dimensions of approximately 26 inches in width, 26 inches in depth, and 25 inches in height.

86. The method of claim 74 further providing the shipping container including a DIM of no greater than 130 inches.

87. The method of claim 74 further providing the shipping container including a DIM of no greater than 135 inches.

88. The method of claim 74 further providing the shipping container including a DIM of no greater than 140 inches.

89. The method of claim 74 further providing the shipping container including a DIM of no greater than 145 inches.

90. A method comprising the steps of:

providing an office chair including a seat section, a back section, and a base section including a central axis and a plurality of leg members that extend in a radial direction relative to the central axis, wherein the plurality of leg members is adapted to accept wheels;

placing at least one protective shipping sleeve over an edge portion of the back section, wherein the shipping sleeve is sized and shaped so as to cover the edge portion of the back section;

providing a single shipping container including a DIM of no greater than 130 inches;

arranging the seat section, the back section and the base section of the office chair inside the single shipping container so that the single shipping container is capable of closing;

closing the single shipping container; and sending the single shipping container via overnight delivery.

91. A method comprising the steps of:

providing an office chair including a seat section, a back section and a base section, the base section including a central axis and a plurality of leg members that extend in a radial direction relative to the central axis, wherein the plurality of leg members is adapted to accept wheels;

placing at least one protective shipping sleeve in contact with an edge portion of the back section and partially over a portion of the back section;

providing a single shipping container including a DIM of no greater than 150 inches;

arranging the seat section, the back section and the base section inside the single shipping container so that the single shipping container is capable of closing;

closing the single shipping container; and sending the single shipping container via overnight delivery.

* * * * *

UNITED STATES PATENT AND TRADEMARK OFFICE

CERTIFICATE OF CORRECTION

PATENT NO. : 6,804,938 B2
DATED : October 19, 2004
INVENTOR(S) : Marc A. Levin and Barry L. Donahue It is certified that error appears in the above-identified patent and that said Letters Patent is hereby corrected as shown below:

Column 7,
Line 57, delete "the" (second occurrence).

Column 8,
Lines 38 and 39, delete claim 41.

Signed and Sealed this

Twenty-first Day of June, 2005

JON W. DUDAS
*Director of the United States Patent and Trademark Office*